United States Patent [19]

Williams

[11] Patent Number: 4,956,962

[45] Date of Patent: Sep. 18, 1990

[54] METHOD OF MAKING RECLOSABLE SEALED PACKAGE

[75] Inventor: Roger S. Williams, Calhoun, Ga.

[73] Assignee: Bryan Food, Inc., West Point, Miss.

[21] Appl. No.: 379,913

[22] Filed: Jul. 14, 1989

[51] Int. Cl.[5] ..... B65B 9/04; B65B 31/02; B65B 47/00

[52] U.S. Cl. ..... 53/433; 53/410; 53/450; 53/453; 156/292

[58] Field of Search ..... 53/383, 410, 433, 450, 53/452, 453, 456, 478, 432; 156/289, 291, 292, 308.4, 314, 315; 206/461, 470, 471, 632

[56] References Cited

U.S. PATENT DOCUMENTS

| | | | |
|---|---|---|---|
| 3,673,760 | 7/1972 | Canamero et al. | 53/453 X |
| 4,365,716 | 12/1982 | Watt | 156/308.4 X |
| 4,415,087 | 11/1983 | Clayton et al. | 206/632 |
| 4,502,599 | 3/1985 | Perecman | 206/554 |
| 4,572,377 | 2/1986 | Beckett | 206/632 X |
| 4,674,634 | 6/1987 | Wilson | 206/554 |
| 4,819,409 | 4/1989 | Mahaffy et al. | 53/383 X |

*Primary Examiner*—Robert L. Spruill
*Assistant Examiner*—Linda B. Johnson
*Attorney, Agent, or Firm*—Alan Ruderman

[57] ABSTRACT

A resealable hermetically sealed package for food products has the product contained between two sheets of thermoplastic material which are sealed together by a permanent heat fused seal about the product except for one edge along which the sheets are adhesively glued together by an easily peeled resealable seal. The process for manufacturing the product forms the adhesive seal prior to the permanent seals in an area remote from that in which evacuation and the final seal occurs. Thus, the final sealing and evacuation of the package is performed in the absence of adhesive so that no adhesive can be drawn into evacuation slots so as to economically produce the product.

15 Claims, 2 Drawing Sheets

METHOD OF MAKING RECLOSABLE SEALED PACKAGE

BACKGROUND OF THE INVENTION

This invention relates to a hermetically sealed package having a reclosable seal, and more particularly to a food containing evacuated package having a peelable reclosable adhesive seal at least at one edge and a hard seal at the other edges about the product, and a method of forming the package.

Various processed meats, cheeses and other food products are packaged and marketed in transparent flexible thermoplastic packages which have been evacuated and hermetically sealed to maintain the original freshness and texture. Once the seal of such packages are opened if the contents are not then completely consumed, the balance of the contents must be refrigerated to prevent it from becoming stale within a short time. Repackaging of the remaining product has been the usual manner of preserving the contents, but the prior art recently has developed packaging having resealing means once the package has been opened. Certain of these package resealing means are relatively complex to use properly and require extensive directions on the packages, while others can be destroyed during the original opening procedure due to the packaging material used.

Although the packaging may help to sell the product, one should not lose sight of the fact that it is the product within the package and not the package itself that is the object of purchase by the consumer. Thus, the cost of the package and packaging process should be a relatively small portion of the overall sales price. In order to ensure this result, packaging must be designed so that the packaged product can be produced at relatively high rates. Accordingly, packaging having reclosable sealing features must be balanced against the cost for producing such packaging.

The prior art describes numerous packaging developments directed toward solving certain of the aforesaid problems. For example, Greisbach et al U.S. Pat. No. 4,782,951 and Sanborn U.S. Pat. No. 4,437,293 disclose evacuated hermetically sealed packaging having interlocking closure strips which are used for reclosing the package after the original seal has been broken. In the former development the closure strip is outside of a peelable hermetic seal while in the latter the closure strip is inside of a hard or permanent heat seal. Lingenfelter U.S. Pat. No. 3,181,583 and Branson U.S. Pat. No. 4,787,755 show similar closures for a reclosable pouch or bag which is not initially evacuated. Other prior art include Van Erden et al U.S. Pat. No. 4,786,190 which describes a bag which may or may not be evacuated and has a non-reclosable peel seal or tear closure which must be broken, a flap having an adhesive strip acting a reclosable closure. Other U.S. Pats. showing bags which are not evacuated and may or may not initially have a product but have a reclosable adhesive feature include Kratzer et al No. 3,307,773; Hoblit et al No. 3,310,225; Clayton et al No. 4,415,087 and Yanase No. 04,486,814. In Scott U.S. Pat. No. 4,498,588 an evacuated hermetically sealable and reclosable package has a separate peelable adhesive film or mat entirely about the product between a base member and a preformed body or package or chamber, the mat being heat sealed to one of the members and peelably sealed to the other about the product. Numerous other peelable hermetic seals are shown in the prior art which are not resealable, including Seifeith et al U.S. Pat. Nos. 3,498,018 and 3,647,485 and Schirmer et al U.S. Pat. No. 4,382,513.

Despite all of these developments, an inexpensive peelable resealable hermetically sealed package which is simple to use and inexpensive to manufacture has eluded the prior art.

SUMMARY OF THE INVENTION

Consequently, it is a primary object of the present invention to provide a hermetically sealed package having a reclosable peelable seal which can be readily opened to gain entry to the product within the package and can be resealed merely by manual pressure applied to the seal.

It is another object of the present invention to provide a reclosable hermetically sealed package which may be produced at commercially acceptable rates in a single pass machine using two sheets of material which may or may not be formed about a product but which has a peelable adhesive along a joined edge adjacent the product and has a hard or permanent seal about the remainder of the product.

It is a further object of the present invention to provide a method for producing a hermetically sealed package containing a food product, the package having a peelable resealable adhesive seal about a portion of the product and a hard or permanent heat seal about the remainder of the package, the adhesive seal being formed prior to the hard seal and prior to the evacuation of the package.

Accordingly, the present invention provides a resealable hermetically sealed package for food products which has the product contained between two sheets of thermoplastic material which are sealed together by a permanent heat fused or hard seal about the product except for one edge wherein the sheets are adhesively glued together by an easily peeled resealable seal. The package is produced by a process wherein the adhesive seal is formed prior to the hard seals and in an area remote from the area where evacuation occurs and the final seal is made.

The use of a hot melt pressure-sensitive adhesive to provide a peelable resealable seal and an initially hermetic seal is a more economical solution to the problem of resealing a package for refrigeration and the like than that of providing interlocking closure strips. Additionally, a resealable adhesive seal requiring only the mere overlaying of one sheet of material onto the other and together with the application of minimal manual pressure is easier and simpler for the consumer to perform than the alignment of closing of interlocking elements. The problem presented is that when evacuation of the package is produced by the sub-atmospheric pressurization, commonly called drawing a vacuum, of the package in the sealing chamber, the adhesive or glue is drawn into the evacuation slots of conventional package forming machines. These slots are generally in the order of approximately one-eighth of an inch by one inch and the adhesive can, after a relatively short production run, clog these slots requiring the shutting down of the machine. Such a result diminishes or eliminates the economical advantages of the adhesive seal. Accordingly, it is an important aspect of the present invention to pre-glue the sheets of thermoplastic material prior to the package entering the area where the evacuation and final sealing step is performed, the latter step being one of forming a hard or permanent fusion seal.

Thus, in accordance with the present invention the final sealing and evacuation of the package is performed in the absence of adhesive or glue since the sheets are already glued together by the peelable adhesive prior to the final sealing and evacuation steps. Therefore, when the vacuum is then drawn and the final hard seal is produced, no glue can be drawn into the evacuation slots so that minimum maintenance of the machinery is required and long production runs may be made.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
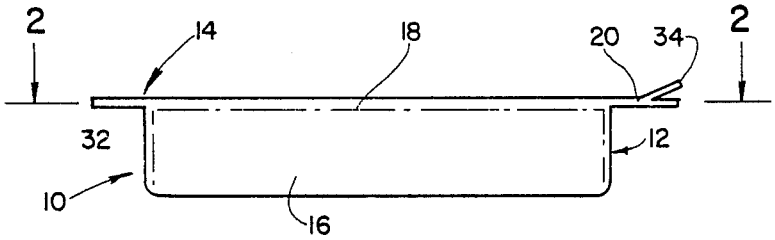
FIG. 1 is an elevational view of a package constructed in accordance with the principles of the present invention, the product package therein being illustrated in phantom.

Referring to the drawings, a package constructed in accordance with the present invention is generally illustrated at 10, the package comprising a first or bottom portion 12 formed from forming film which may comprise a plurality of plies or laminates of thermoplastic film material, and a second or covering portion 14 which is formed from lidding stock which may also comprise a plurality of plies or laminates of thermoplastic film material. The particular materials from which the bottom portion and the covering portion are formed are conventional and may be varied dependent upon the desired strength of the package, the product contained therein and whether or not the bottom and covering portions are formed with cavities or pouches or are merely of a bag-type construction. For example, as illustrated, the bottom portion is formed with a cavity 16, for receiving a product, illustrated at 18 in phantom, which may be luncheon meat, wieners, cheese or the like. In this instance the bottom portion may comprise a sheet of material preformed in a sandwich construction from nylon, Saran brand copolymer of polyvinylidene chloride, and Surlyn brand ionomer with the ionomer being on the interior or product side and the nylon on the exterior of the package. Furthermore, the covering, as illustrated may not be formed but is merely a covering material and since it need not have the strength of a forming material it may substitute a polyester material for the nylon.

The package 10 is hermetically sealed to preserve the original freshness of the product and in accordance with the present invention the package includes a first seal 20 formed by an adhesive applied to one end of the bottom of the package prior to the remaining seals 22, 24, 26 which comprise hard seals respectively at the sides 28, 30 and other end 32 of the package. The adhesive is a pressure-sensitive material that had good adhesion so that a hermetic seal may be formed, yet it has a low peel strength and is peelable from a large variety of substrates including those heretofore mentioned. An adhesive that meets this criteria is manufactured by Century Adhesives Corporation of Columbus, Ohio under the product identification No. CA-502-4A. This adhesive has a specific gravity of 0.9777, is non-toxic, and is a hot melt adhesive that when in the hot state has a relatively low viscosity so that it may be pumped through a nozzle onto a surface of the bottom portion 12. It may be applied a slight distance from the end of the bottom so that a small tab 34 may be formed for easily peeling the covering material 14 from the bottom portion 12 at the adhesive seal. As aforesaid, the remaining seals are hard seals, which is defined as a permanent fusion or welded seal formed by heat staking the materials of the covering and bottom portions together.

Figure 2:
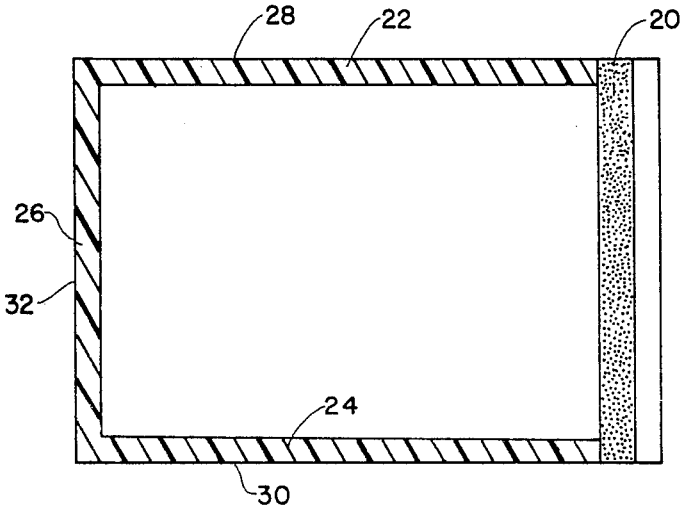
FIG. 2 is a cross sectional view taken substantially along line 2—2 of FIG. 1.
Figure 3:
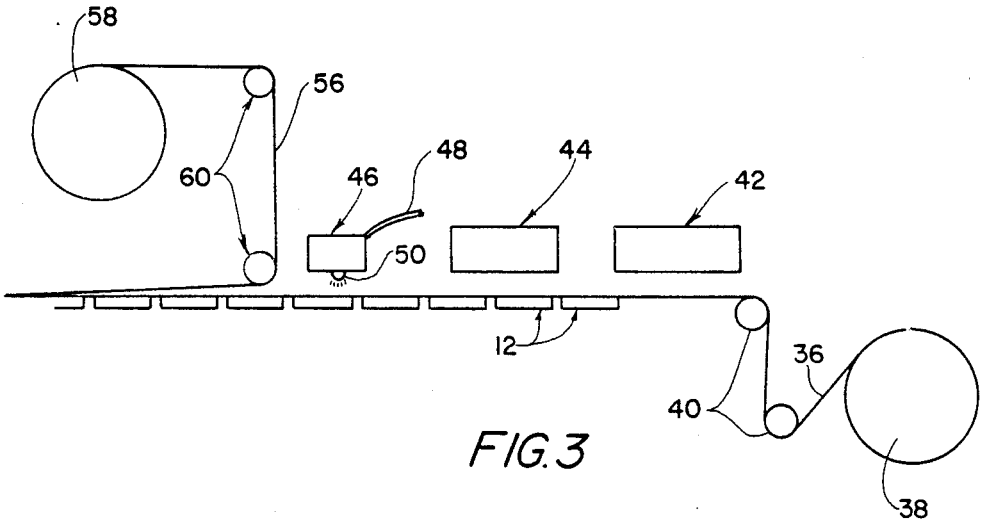
FIG. 3 is a schematic view of the initial portion of the processes of the present invention for forming the package illustrated in FIG. 1.
Figure 4:
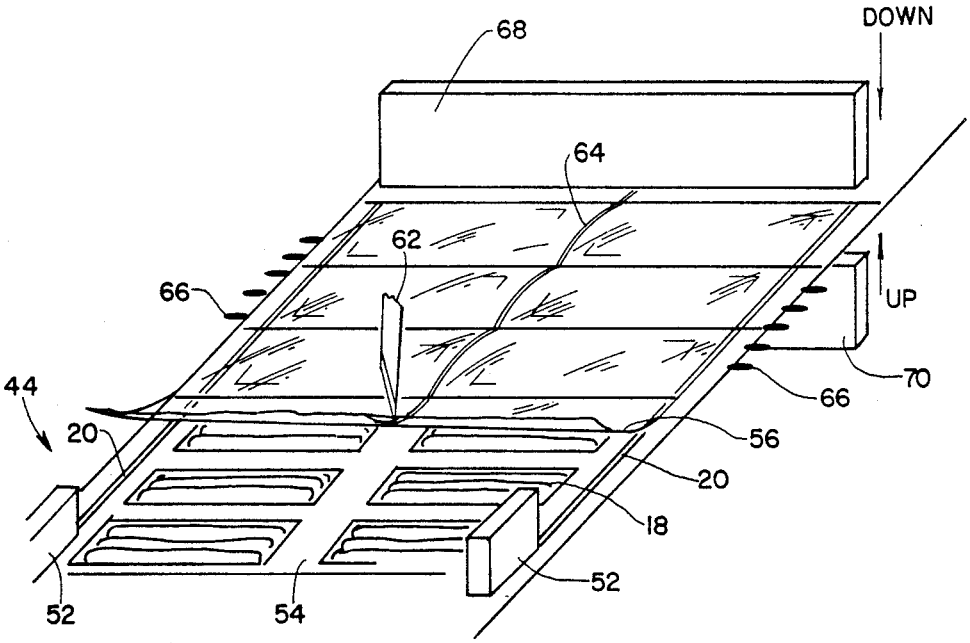
FIG. 4 is a diagrammatic perspective view of apparatus for performing an intermediate portion of the package forming process.

In the process of forming the package 10, as illustrated in FIG. 3, the sheet of forming material or stock 36 for forming the bottom 12 is paid out from a roll 38 about a number of guide and/or feed rollers generally indicated at 40 and fed to the forming station 42 of the machine wherein the stock is heated and formed into the desired shape of the bottom of the package by conventional means including the drawing of a vacuum and the application of compressed air to form the stock in conjunction with one or more forming dies. Of course, if the bottom is to remain unformed as in the case of a pouch or bag, this step may be omitted. As illustrated, the formed bottoms 12 are thereafter fed to the product inserting station 44 where the food product is inserted, and then moves on to the gluing or adhesive applying station 46 wherein the adhesive is fed through a conduit 48 from a heated glue tank (not illustrated) to the nozzle 50 of a hot glue gun 52 located at the gluing station 46. As illustrated in FIG. 4 it is preferred to feed the stock in a width sufficient to form two bottoms simultaneously and to apply the adhesive by a pair of glue guns at remote ends thereof with a margin or central web portion 54 of the stock maintaining the side-by-side relationship of the formed bottom portions. The glue applicator nozzle preferably has an elongated slot so that the glue is applied as an adhesive strip 20, as illustrated in FIG. 2, adjacent the remote ends of the two portions.

Subsequent to the application of the adhesive to the bottom portion, the product supporting sheet moves into an upper or covering sheet dispensing station where the sheet of covering stock material 56 is paid out from a roll 58, the sheet 56 being fed about a number of guide and/or feed rollers generally indicated at 60. The sheet 56 is laid onto the bottom portion and adheres to the adhesive 20 on the ends thereof. As the now covered bottom continues to move through the machine, a cutter such as a knife 62 is disposed for slitting the covering material in the area above the margin or central web 54. Only the covering material is slit so that the packages remain connected as they proceed to the first stage hard sealing station, the slit 64 providing the opening for subsequent evacuation at the final hard sealing station.

As the attached bottom portions with the slit covering material commence entry to the first stage hard sealing area where the side seals 22 and 24 are formed, they pass through a station wherein clips 66 are disposed for engaging the ends of the covering and forming materials adjacent the glued strips for supporting the packages as they enter between at least one and preferably two heat applying anvils 68, 70. These anvils are heated to a temperature sufficient to fuse or bond the thermoplastic material of the bottom portion and covering sheet together as a hard seal at the side margins between adjacent packages, pressure being applied by the anvils to the material at the same time as the heat is applied. Thus, the sides 28, 30 of each package are closed by the respective hard seal 22, 24. When two anvils are utilized they may be moved into and out of engagement with the thermoplastic materials therebetween; if one anvil is used it may be moved toward and away from a fixed rib or support member and the thermoplastic materials are squeezed between the heated anvil and the fixed rib to form the hard seals at the sides. During each cycle of movement of the anvils, the packages are indexed to move between stations, and after the hard seals are formed at the sides, the packages are indexed to the final seal and evacuation station illustrated in FIG. 5. If desired a number of pairs of anvils and/anvil-rib combinations may be utilized so that the hard seals may be formed at the sides of a number of packages simultaneously so that during each cycle more than the leading two packages will be indexed to the next station.

Figure 5:
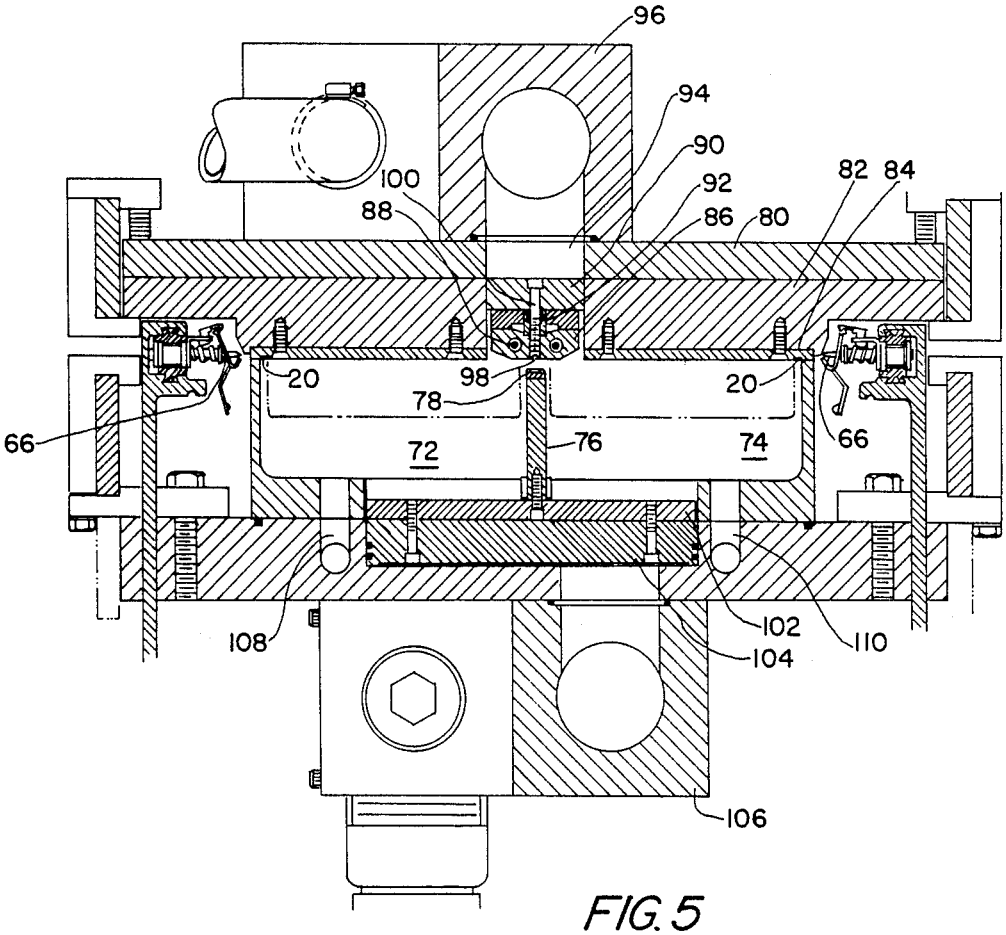
FIG. 5 is a cross sectional view taken through a portion of a machine for forming the final seal and evacuating the package.

Referring now to FIG. 5, the final seal and evacuation is performed by the apparatus illustrated. Here the packages enter a pair of side-by-side cavities 72, 74, one package being received in each cavity. Of course a number of such cavities may be disposed serially with the two illustrated so that upon each index of the machine a plurality of packages may be sealed and hermetically evacuated. A support rib 76 is disposed between each pair of packages and a forming head 78 is fastened to the top of the rib. A water cooled plate 80 carries a heater mounting plate 82 at the bottom of which a seal pad 84 is carried. A heater 86 carrying a number of electrical heater elements 88 is supported from a base plate 90 with an insulator spacer 92 therebetween, the heater, base plate and insulator being disposed in an opening 94 in the plate 80 and mount 82 which communicates with the port of a valve chamber 96 within which a sub-atmospheric pressure or vacuum may be drawn. The bottom of the heater 86 carries a hollow annular seal forming head 98 aligned with the rib head 78 and is held by a hollow bolt 100 which communicates with the annulus of the head and with the opening 94. The rib 76 is carried by a mounting plate 102 supported on a piston 104, the piston being adapted to be reciprocated by high pressure feed to another valve chamber 106. Other vacuum drawing ports 108, 110 may be disposed beneath and communicate with the respective cavity 72, 74. When suction is drawn through the ports 94, 108, 110, air is ported by the valve 106 to drive the piston 104 upwardly to contact the rib head 78 with the heater head 98 to form the final hard seal 26 at the margin between two packages. Thus, not only are the packages hermetically sealed, but the final hard or permanent seal 26 is formed on each package. Subsequently, the packages are fed to cutter means where the packages are separated by slitting the margins between the respective packages.

Although the preferred form of the invention has been disclosed, other obvious forms of the package may be readily made as inherently taught by the present disclosure. For example, with certain food products it may be desired that the package have the easily peelable adhesive seal at more than one edge, and the hard seal at less than three edges. In any event, in accordance with the present invention, a hermetically sealed package having at least one hard seal and one easily peelable resealable adhesive seal is required.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of forming a package having a product hermetically enclosed therein between a pair of sheets of thermoplastic material and having a readily peelable reclosable seal, said method comprising:

(a) feeding a first sheet of thermoplastic material, (b) placing said product upon a surface of said sheet, (c) dispensing a peelable pressure sensitive adhesive having re-adhering properties onto said surface at a peripheral area of said sheet adjacent said product, (d) thereafter laying a cover sheet of material upon said first sheet so that said covering material overlays and adheres to said adhesive and forms a peelable resealable seal and overlays said product and the remainder of said first sheet, (e) thereafter joining the first and second sheets together peripherally about said product at all but a second peripheral area of said sheet spaced from said adhesive adjacent said product, and (f) thereafter evacuating said package and permanently sealing the first and second sheets together about said second area.

2. The method as recited in claim 1, wherein said joining of said first and covering sheets together comprises permanently sealing said sheets together so that said sheets are permanently joined except at said first area.

3. The method as recited in claim 2, wherein said first sheet is formed with a product receiving cavity and periphery margins about said cavity prior to said product being placed thereon, and said product is inserted into said cavity.

4. The method as recited in claim 3, wherein said adhesive is disposed onto a peripheral margin adjacent said cavity.

5. The method as recited in claim 1, wherein the step of permanently sealing said first and covering sheets comprises fusing said sheets together by pressing said sheets together and applying heat to said sheets.

6. The method as recited in claim 5, wherein said joining of said first and covering sheets together comprises permanently sealing said sheets together so that said sheets are permanently joined except at said first area.

7. The method as recited in claim 6, wherein said first sheet is formed with a product receiving cavity and peripheral margins about said cavity prior to said product being placed thereon, and said product is inserted into said cavity.

8. The method as recited in claim 7, wherein said adhesive is disposed onto a peripheral margin adjacent said cavity.

9. The method as recited in claim 1, wherein said first sheet is formed with a pair of product receiving cavities and peripheral margins about each cavity prior to said product being placed thereon, inserting said product into each cavity, and wherein said adhesive is dispensed onto a pair of remote margins of said first sheet with both cavities intermediate said remote margins.

10. The method as recited in claim 9, wherein said covering sheet is dispensed onto said first sheet in overlaying relationship with the adhesive at both remote margins, and thereafter slitting said covering material in an area above and intermediate both cavities to form a pair of cut edges of said covering material.

11. The method as recited in claim 10, wherein said cavities have a polygonal shape and said adhesive is dispensed onto remote side margins adjacent both cavities.

12. The method as recited in claim 11, wherein said sheets are permanently sealed together about the entire periphery margins adjacent said cavities except said side margins, and the margins intermediate both cavities are sealed to respective cut edges of said covering material subsequent to the sealing of the remainder of said margins.

13. The method as recited in claim 12, wherein the step of permanently sealing said first and covering sheets comprises fusing said sheets together by pressing said sheets together and applying heat to said sheets.

14. The method as recited in claim 12, wherein said cavities are evacuated along respective cut edges just prior to sealing said edges.

15. The method as recited in claim 14, wherein the step of permanently sealing said first and covering sheets comprises fusing said sheets together by pressing said sheets together and applying heat to said sheets.

* * * * *